US006715267B2

(12) United States Patent
Schaefer et al.

(10) Patent No.: US 6,715,267 B2
(45) Date of Patent: Apr. 6, 2004

(54) METHOD AND SYSTEM FOR PACKING MATERIALS FOR SHIPMENT

(75) Inventors: James V. Schaefer, Ann Arbor, MI (US); Robert J. Bell, Livonia, MI (US)

(73) Assignee: Schneider Automation Inc., North Andover, MA (US)

( * ) Notice: Subject to any disclaimer, the term of this patent is extended or adjusted under 35 U.S.C. 154(b) by 72 days.

(21) Appl. No.: 09/918,871

(22) Filed: Jul. 31, 2001

(65) Prior Publication Data

US 2003/0024212 A1 Feb. 6, 2003

(51) Int. Cl.[7] ..... B65B 1/30; B65B 3/26; B65B 57/10

(52) U.S. Cl. ..... 53/498; 53/494; 53/473; 209/702

(58) Field of Search ..... 53/498, 494, 473, 53/475; 209/702, 706, 703, 942; 273/156, 454, 455, 273, 460; 434/359, 219; 463/36; 446/175

(56) References Cited

U.S. PATENT DOCUMENTS

| | | | | | |
|---|---|---|---|---|---|
| 4,944,411 | A | * | 7/1990 | Fukushima | 209/705 |
| 5,575,134 | A | * | 11/1996 | Main | 53/475 |
| 5,620,102 | A | * | 4/1997 | Finch, Jr. | 209/705 |
| 5,823,357 | A | * | 10/1998 | Sieradzki et al. | 209/702 |
| 6,079,570 | A | * | 6/2000 | Oppliger et al. | 209/706 |
| 6,122,895 | A | * | 9/2000 | Schubert | 53/475 |
| 6,305,548 | B1 | * | 10/2001 | Sato et al. | 209/702 |
| 6,425,487 | B1 | * | 7/2002 | Emmott et al. | 209/703 |

FOREIGN PATENT DOCUMENTS

WO WO 9404446 A1 * 3/1994 ..... B65G/1/02

* cited by examiner

*Primary Examiner*—Anthony D. Stashick
(74) *Attorney, Agent, or Firm*—Larry I. Golden; David R. Stacey

(57) ABSTRACT

The present invention is directed to a method and system for packing an order of parts. An operator is prompted to select an indicated part. The part is read by the system to verify the selection of the part. An array of indicators directs the operator to where the part should be placed in a shipping tote. An array of sensors confirms the packing of the part.

43 Claims, 3 Drawing Sheets

METHOD AND SYSTEM FOR PACKING MATERIALS FOR SHIPMENT

TECHNICAL FIELD

This invention relates generally to the field of packing materials. More specifically, the present invention relates to a method and system for ensuring proper packing of an order of parts for shipment.

BACKGROUND OF THE INVENTION

Many parts suppliers are required to deliver a shipment of parts in a specified sequence. These parts suppliers are also being required to utilize "just in time" manufacturing processes that maintain very small inventories. In some cases, large orders of identical parts common in years past are uneconomical and are no longer considered good business practice.

Today, many manufacturing or assembly plants place orders consisting of a variety of parts. These parts are provided in shipping totes that may be sequenced in the same order that an assembled product travels during production on an assembly line. These sequenced totes consisted of a combination of colors packed in a seemingly random order. Often times, assembly line personnel found working with the totes difficult due to incorrectly packed parts.

Because of the tedious and monotonous nature of placing the parts in the tote, errors frequently occurred during packing. Improperly packed shipping totes can cause significant downtime of the assembly line process in which the parts are utilized. In addition, remedying a shipment of incorrectly packed totes may result in shipment returns and re-packing of the totes. Obviously, packing errors can contribute to significant losses, both in time and money.

This invention is directed to solving these and other problems.

SUMMARY OF THE INVENTION

The present invention is directed to a method of packing a shipment of parts. The method comprises indicating a part for packing and confirming selection of the part. A location in a shipping tote is indicated for placing the selected part. And the location of the shipping tote is sensed for the placement of the selected part.

A further aspect of the present invention comprises confirming the placement of the selected part in the shipping tote. The packed part is monitored and an alarm is generated in response to the removal of the part from the shipping tote.

Yet a further aspect of the present invention comprises providing a programmable device, an array of sensors, and an array of indicators. The array of sensors and the array of indicators being adaptable to the shipping tote. The programmable device being operably connected to the array of sensors and the array of indicators wherein the programmable device cooperates with the array of sensors and the array of indicators to ensure proper placement of the selected parts for shipping.

Another embodiment of the present invention is directed to a packing system comprising a programmable device being operably connected to a pack station. A shipping tote for holding parts selected for packing is adaptable to the pack station. The pack station comprises an array of indicators and an array of sensors. Each array being adaptable with the shipping tote wherein the arrays cooperate with the programmable device to ensure proper packing of the selected parts in the tote.

An object of the present invention is to reduce or eliminate mistakes in a packing process of a variety of parts. The reduction of packing mistakes may reduce the amount of downtime in the packing process itself, and in subsequent processes utilizing the packed parts.

Other features and advantages of the invention, which are believed to be novel and nonobvious, will be apparent from the following specification taken in conjunction with the accompanying drawings in which there is shown a preferred embodiment of the invention. Reference is made to the claims for interpreting the full scope of the invention, which is not necessarily represented by such embodiment.

BRIEF DESCRIPTION OF THE DRAWINGS

In order that the present invention may be more fully understood, it will now be described by way of example, with reference to the accompanying drawings in which.

DETAILED DESCRIPTION

Although this invention is susceptible to embodiments of many different forms, a preferred embodiment will be described and illustrated in detail herein. The present disclosure exemplifies the principles of the invention and is not to be considered a limit to the broader aspects of the invention to the particular embodiment as described.

Figure 1:
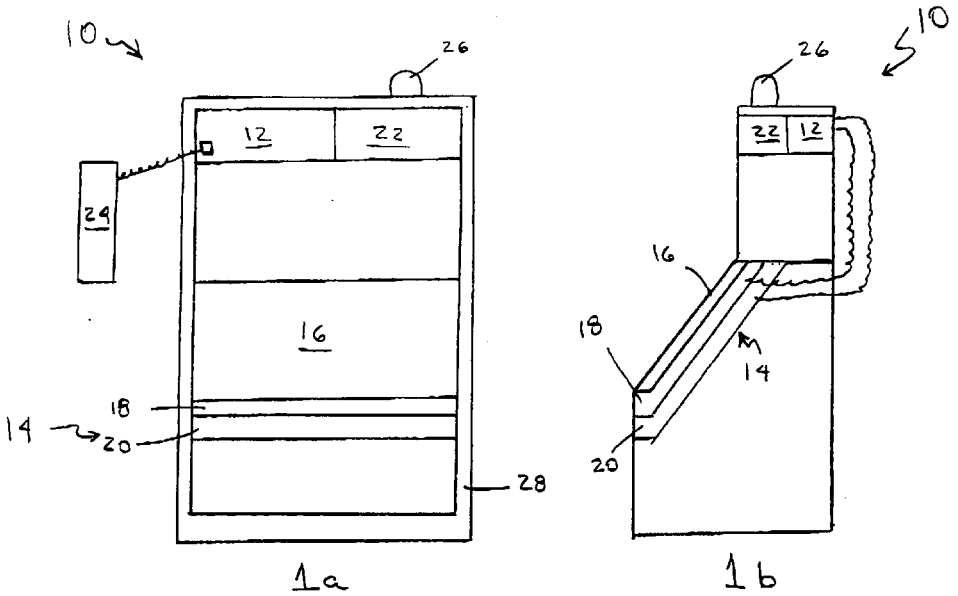
FIG. 1*a* is an front view sketch of one embodiment of the present invention.
FIG. 1*b* is an side view sketch of FIG. 1*a;*

A packaging system 10 for facilitating the packing of a shipment of parts is shown in FIGS. 1*a* and 1*b*. The packaging system includes a programmable device 12 being operably connected to a pack station 14. Preferably, the programmable device 12 is a computer, but it is to be understood that programmable logic controllers, personal computers, handheld modules, etc. can also be used. A shipping tote 16 for holding parts selected for packing is adaptable to the pack station 14. The shipping tote 16 has one or more locations 30, e.g., pockets, for receiving parts that are packed for shipping. The shipping tote 16 may also function as an insert into a more generic shipping tote.

The pack station 14 comprises an array of indicators 18. The array of indicators 18 being operably connected to the programmable device 12 and further being adaptable for cooperation with the shipping tote 16 wherein the array of indicators cooperates with the programmable device to ensure proper placing of the selected parts. Each location 30 in the shipping tote 16 is associated with one or more indicators 19 from the array of indicators 18.

The pack station 14 also includes an array of sensors 20. The array of sensors 20 are operably connected to the programmable device 12 and further being adaptable for cooperation with the shipping tote 16 wherein the array of sensors cooperates with the programmable device to ensure proper placement of the selected parts. Similar to the array of indicators 18, each location 30 utilized in the shipping tote 16 is associated with one or more sensors 21 from the array of sensors 20.

A part indicator 22 is operably connected to the programmable device 12. The part indicator 22 prompts an operator by indicating the part to be selected for placing in the shipping tote 16. The part indicator 22 indicates to the operator the part to be selected for packing. The indication of a part can be accomplished via any means for notifying the operator, i.e., visual, aural, smell, taste, touch, etc. After the part has been indicated for packing and selected by the operator, the operator uses a reader 24 to read a part identifier. Preferably, the selected part includes some type of identification, i.e., barcode, serial no., etc. The reader 24 facilitates transferring the part identifier to the programmable device 12 wherein the selection of the part is confirmed. The reader 24 can be a scanner, wand, keyboard, handheld device, optical probe, or any other means known for such function.

The programmable device 12 confirms the operator's selection of the indicated part. The operator verifies the confirmation and identifies a location 30 within the shipping tote 16 indicated by the programmable device 12 for placement of the part. The location 30 is indicated by the illumination of an indicator 19. Proper placement of the selected part within the indicated location 30 is sensed by the programmable device 12.

An alarm 26 can also be incorporated with the packing system 10. The alarm being responsive to the reader 24 wherein reading an incorrectly selected part generates an alarm signal executed by the alarm. The generated alarm signal can be transmitted visually, aurally, electrically, physically or through any other medium capable of being sensed.

Alternatively, the alarm 26 can be responsive to the array of sensors 20 wherein detection of a misplaced part in the shipping tote 16 generates an alarm signal executed by the alarm. Further still, the alarm can be responsive to the array of sensors 20 wherein detection of a removed part from the shipping tote 16 generates the alarm signal executed by the alarm.

Figure 3:
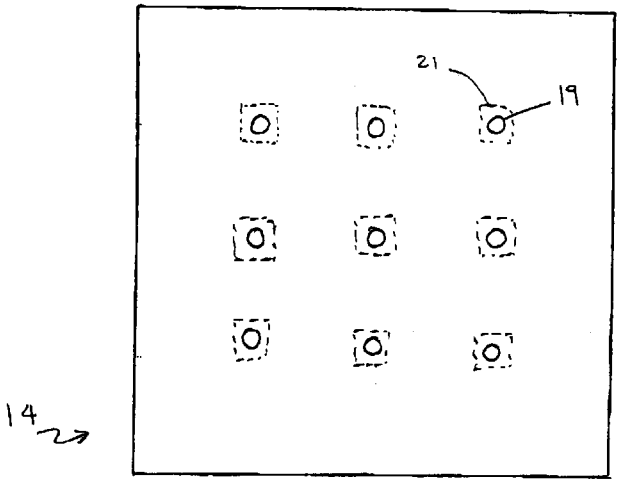
FIG. 3 is a top view of one embodiment of the pack station.
Figure 4:
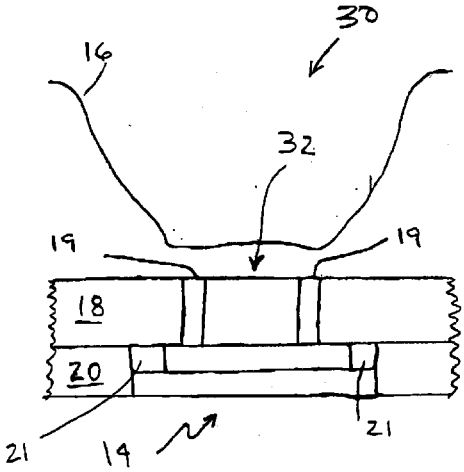
FIG. 4 is a partial cross-sectional view of the pack station in cooperation with the shipping tote.

An exemplification of the preferred embodiment of the present invention comprises a part indicator 22 and an array of sensors 20. Both the part indicator 22 and the array of sensors are operably connected to a support frame 28. A shipping tote 16, preferably an insert to a generic shipping tote, is adaptable for placement over the array of sensors 20. FIGS. 3 and 4. The shipping tote 16 comprises a plurality of locations 30, i.e., pockets, into which the selected parts are received. Near the bottom of each pocket 30 in the shipping tote 16 is an opening 32 through which one of the sensors 21 is operably adapted for cooperation. The opening 32 is large enough for the sensor 21 to sense the presence of a part and for the operator to view the associated indicator 19 of the array of indicators 18. Preferably, the array of indicators 18 comprises at least one indicator 19 comprising a light, e.g., an annular LED. FIG. 4. The sensor and indicator arrays 20, 18 can be operably connected to a programmable device 12 via a custom fabricated circuit board. This circuit board can then be operably connected to the pack station 14.

Figure 2:
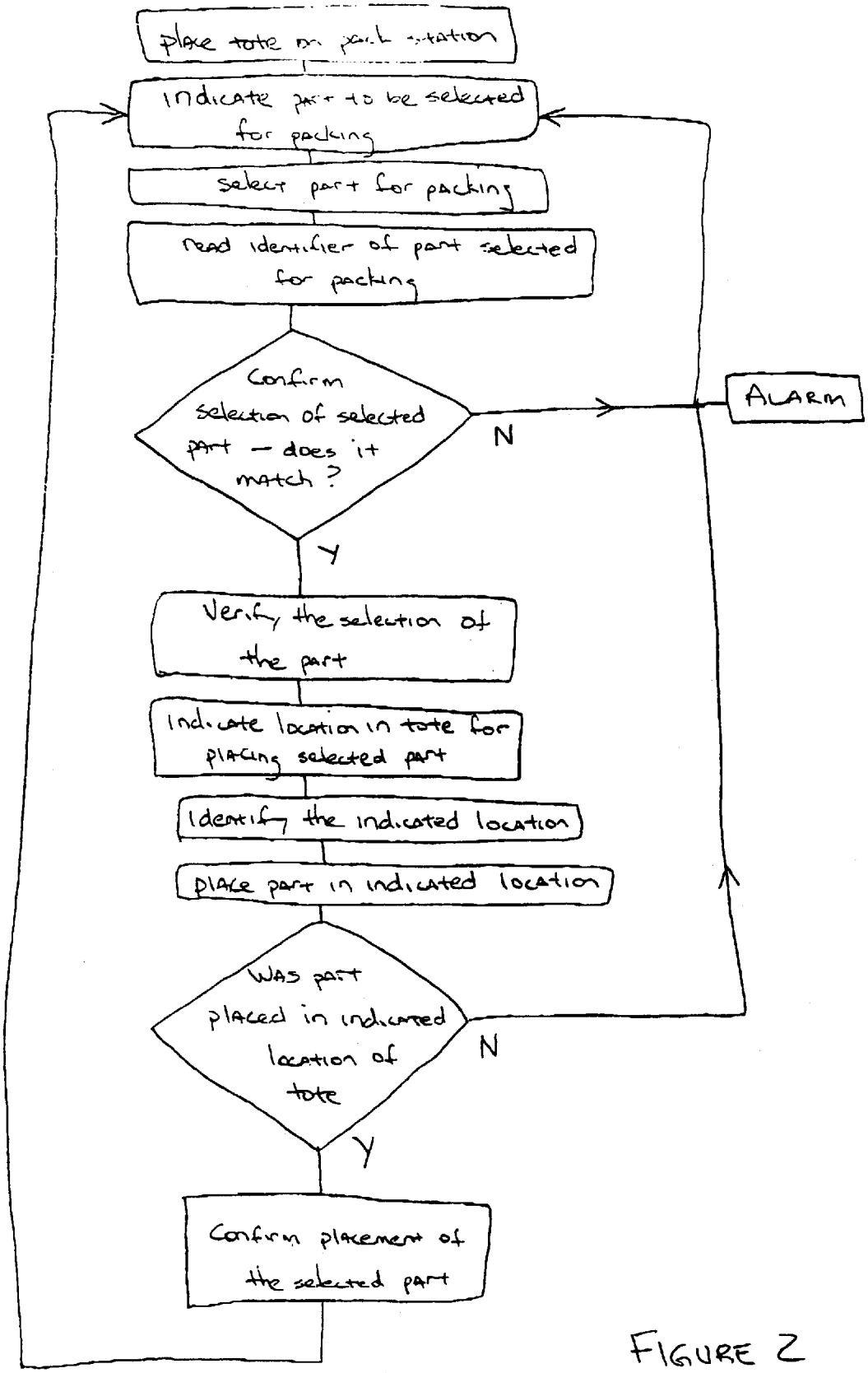
FIG. 2 is a flowchart depicting a packing process of one embodiment of the present invention.

Referring to FIG. 2, the operator begins the packing process by removing a shipping tote insert 16 from a generic shipping tote. The shipping insert 16 is then placed in the pack station 14. Preferably, the shipping insert 16 and the pack station 14 are keyed so there is only one configuration. The openings 32 in the shipping insert 16 align with the sensors 21 in the array of sensors 20. The part indicator device 22 prompts the operator to select a part from a supply and verify the programmable device's 12 confirmation of a match between the selected part and the part indicated by the part indicator 22. To confirm the part, the part identifier is read by the programmable device 12 whereby the operator passes the part under a part reader 24, or scanner. If the correct part is scanned, the LED 19 of the associated pocket 30 is illuminated. The operator verifies the confirmation of the programmable device 12 and identifies the illuminated pocket 30 to receive the part.

Upon proper placement of the part in the pocket 30, the appropriate part sensor 21 detects the part. The part sensor 21 may utilize any known technology for detecting, including but not limited to: motion sensors, barcode readers, scanners, photo-electric sensors, machine vision, capacitive sensors, proximity sensors, ultrasonic sensors, photo optic sensors, etc. The programmable device 12 confirms proper placement of the part by turning off the light 19 in the pocket 30 and recording the part as packed. The programmable device 12 then indicates to the operator the next part to be packed. This process continues until the packing of the shipment is complete. Upon completion, the system 10 prints a shipping label and prompts the operator to remove the full shipping tote 16 and load the next empty tote.

The programmable device 12 is capable of monitoring each pocket 30 in the tote 16 at all times. The programmable device 12 is further able to track and determine whether parts once properly packed were later removed from the shipping tote. If at any time a packed part is removed from the shipping tote 16, the system 10 will alarm to indicate a packing error. To repack the part, the operator must reset the alarm 26 and scan the part under the part scanner 24, repeating the pack cycle. If at any time a part is placed into an incorrect pocket 30, a pack alarm 26 is again executed and the part must be removed from the pocket. If at any time a partially packed tote 16 is removed from the pack station 14, a pack alarm 26 is executed and the entire tote must be repacked.

Preferably, the packing system 10 displays the alarms on the part indicator 22 or by flashing the annular LED light 19 of the affected pocket 30.

Figure 5:
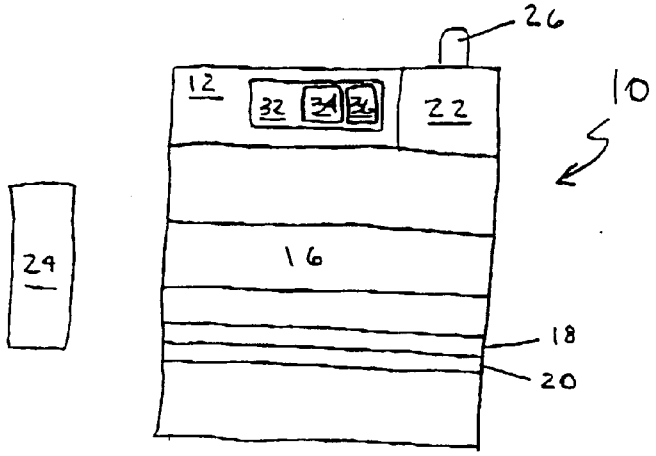
FIG. 5 depicts a an alternative embodiment of the present invention.

Referring to FIG. 5, the packing system 10 is operably connected to an interface 32 for connection to the Internet. The interface 32 comprises a client 34, a server 36, or any combination thereof, and is connected to the programmable device 12 wherein data stored by the device can be remotely accessed. Preferably, the client/server interface 32 is embedded within the programmable device 12. In addition to remotely acquiring production data from the programmable device 12, programs for the device can be transmitted to the programmable device. Thus, new or revised programs can be installed into the device 12 from a remote location via the Internet at any time.

Figure 6:
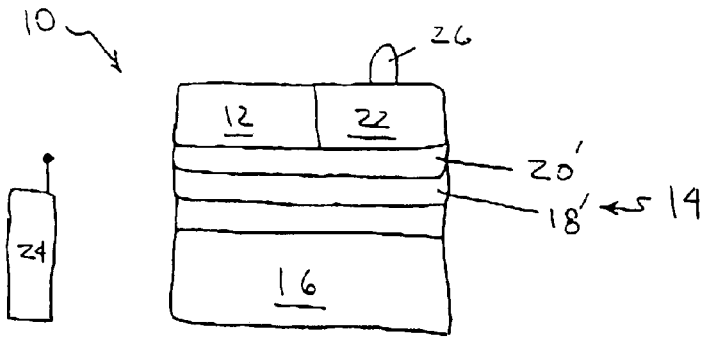
FIG. 6 depicts another alternative embodiment of the present invention; and, FIG. 7 is a close-up cross-sectional view of an alternative embodiment of the pack station in cooperation with the shipping tote.
Figure 7:
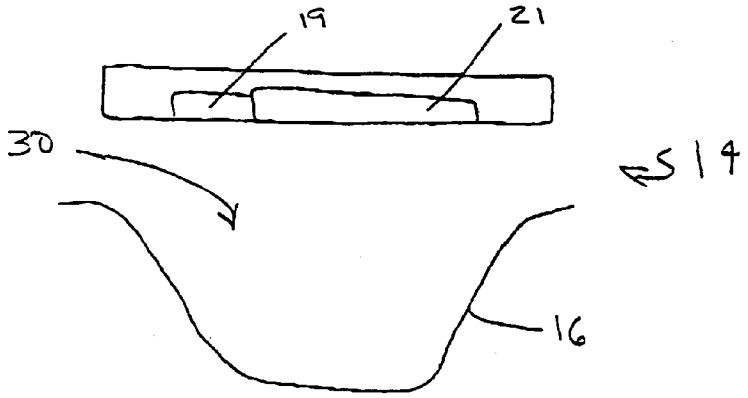

In an alternative embodiment, the present invention can be adapted to an overhead array of indicators 18' and sensors 19' for cooperating with the shipping tote 16 to ensure proper packing of the selected parts. FIGS. 6 and 7.

While the specific embodiments have been illustrated and described, numerous modifications are possible without departing from the scope or spirit of the invention.

We claim:

1. A method of packing a shipment of parts, the method comprising the steps of:

indicating a part selected for packing;

confirming selection of the part;

illuminating a location in a shipping tote for placement of the part; and, sensing placement of the selected part in the location of the shipping tote.

2. The method of claim 1 further comprising the step of:

confirming placement of the selected part into the indicated location in the shipping tote.

3. The method of claim 2 further comprising the step of:

monitoring the part placed in the location in the shipping tote.

4. The method of claim 3 further comprising:

generating an alarm, the alarm being responsive to a failure of the monitoring of the part placed in the location of the shipping tote wherein removal of the placed part from the location in the shipping tote generates the failure.

5. The method of claim 1 further comprising the step of:

generating an alarm, the alarm being responsive to a failure of the confirming selection of the part wherein selection of a wrong part generates the failure.

6. The method of claim 1 further comprising the step of:

generating an alarm, the alarm being responsive to a failure of the sensing placement of the selected part in the location of the shipping tote wherein misplacement of the selected part generates the failure.

7. The method of claim 1 further comprising:

sensing completion of the packing of the parts; and, printing a shipping label in response to the sensed completion of the packing of the parts.

8. The method of claim 1 further comprising:

providing a programmable device;

providing an array of sensors, the array of sensors being operably connected to the programmable device, the array of sensors further being adaptable with the shipping tote; and, providing an array of indicators, the array of indicators being operably connected to the programmable device, the array of indicators further being adaptable with the shipping tote, wherein the array of sensors and the array of indicators cooperate with the programmable device to ensure proper placement of the selected parts for shipping.

9. A method of packing a shipment of parts, the method comprising the steps of:

identifying a part indicated for packing in the shipment;

selecting the part for placing into a shipping tote;

verifying the selection of the indicated part;

illuminating a location indicated in the shipping tote for placement of the selected part; and, placing the selected part in the location in the shipping tote.

10. The method of claim 9 further comprising:

placing the shipping tote for operable cooperation with a pack station, the pack station comprising an array of indicators, the array of indicators being operably connected to a programmable device, the array of indicators further being adaptable with the shipping tote wherein the array of indicators cooperates with the programmable device to ensure proper placement of the part in the shipping tote.

11. The method of claim 10 wherein the pack station further comprises:

an array of sensors, the array of sensors being operably connected to a programmable device, the array of sensors further being adaptable with the shipping tote wherein the array of sensors cooperates with the programmable device to ensure proper placement of the parts in the shipping tote.

12. A method of packing a shipment of parts, the method comprising the steps of:

indicating a part selected for placing in a shipping tote;

identifying the part indicated for placing in the shipping tote;

selecting the part for placing in the shipping tote;

confirming selection of the selected part;

verifying the selection of the indicated part;

illuminating a location in the shipping tote for placement of the selected part;

identifying the illuminated location in the shipping tote for placement of the selected part;

placing the selected part in the illuminated location in the shipping tote;

sensing placement of the selected part in the illuminated location in the shipping tote; and, confirming placement of the selected part in the illuminated location in the shipping tote.

13. The method of claim 12 further comprising the step of:

monitoring the part placed in the location of the shipping tote.

14. The method of claim 13 further comprising:

generating an alarm, the alarm being responsive to the monitoring of the part placed in the shipping tote wherein removal of the placed part from the location of the shipping tote generates the alarm.

15. The method of claim 12 further comprising the step of:

generating an alarm, the alarm being responsive to a failure of the confirming selection of the part wherein selection of a wrong part generates the failure.

16. The method of claim 12 further comprising the step of:

generating an alarm, the alarm being responsive to a failure of the sensing placement of the selected part in the location of the shipping tote wherein misplacement of the selected part generates the failure.

17. The method of claim 12 further comprising:

sensing completion of the shipment of parts; and, printing a shipping label in response to the sensed completion of the shipment of parts.

18. The method of claim 12 further comprising:

providing a programmable device;

providing an array of sensors, the array of sensors being operably connected to the programmable device, the array of sensors further being adaptable with the shipping tote; and, providing an array of indicators, the array of indicators being operably connected to the programmable device, the array of indicators further being adaptable with the shipping tote, wherein the array of sensors and the array of indicators cooperate with the programmable device to ensure proper placing of the selected parts.

19. A packaging system for facilitating the packing of a shipment of parts, the packaging system comprising:

a programmable device;

a shipping tote for holding the part selected for shipping;

a reader being operably connected to the programmable device, the reader for reading the part;

a pack station being operably connected to the programmable device, the pack station comprising an array of sensors, the array of sensors being operably connected to the programmable device, the array of sensors further being adaptable with the shipping tote wherein the array of sensors cooperates with the programmable device to ensure proper placement of the selected parts; and, a part indicator being operably connected to the programmable device, the part indicator for indicating the part to select for placing in the shipping tote.

20. The packaging system of claim 19 further comprising:

an alarm, the alarm being responsive to the reader wherein reading a wrong part generates an alarm signal executed by the alarm.

21. The packaging system of claim 19 further comprising:

an alarm, the alarm being responsive to the array of sensors wherein detection of a misplaced part in the shipping tote generates an alarm signal executed by the alarm.

22. The packaging system of claim 19 further comprising:

an alarm, the alarm being responsive to the array of sensors wherein detection of a removed part from the shipping tote generates an alarm signal executed by the alarm.

23. A packaging system for facilitating the packing of a shipment of parts, the packaging system comprising:

a programmable device;

a shipping tote for holding the part selected for shipping;

a reader being operably connected to the programmable device, the reader for reading the part a pack station being operably connected to the programmable device, the pack station comprising an array of indicators, the array of indicators being operably connected to the programmable device, the array of indicators further being adaptable with the shipping tote wherein the array of indicators cooperates with the programmable device to ensure proper placing of the selected parts; and, a part indicator being operably connected to the programmable device, the part indicator for indicating the part to select for placing in the shipping tote.

24. The packaging system of claim 23 further comprising:

an array of sensors, the array of sensors being operably connected to the programmable device, the array of sensors further being adaptable with the shipping tote wherein the array of sensors cooperates with the programmable device to ensure proper placement of the selected parts.

25. The packaging system of claim 23 further comprising:

an alarm, the alarm being responsive to the reader wherein reading a wrong part generates an alarm signal executed by the alarm.

26. The packaging system of claim 24 further comprising:

an alarm, the alarm being responsive to the reader wherein reading a wrong part generates an alarm signal executed by the alarm.

27. The packaging system of claim 24 further comprising:

an alarm, the alarm being responsive to the array of sensors wherein detection of a misplaced part in the shipping tote generates an alarm signal executed by the alarm.

28. The packaging system of claim 24 further comprising:

an alarm, the alarm being responsive to the array of sensors wherein detection of a removed part from the shipping tote generates an alarm signal executed by the alarm.

29. The packaging system of claim 23 further comprising:

an interface being operably connected to the programmable device, the interface being adapted for connection to the Internet wherein data can be transmitted and received between the programmable device and a remote location.

30. The packaging system of claim 29 wherein the interface comprises a server, the server being embedded in the programmable device.

31. For the packing system of claim 19, a method of packing a shipment of parts, the method comprising the steps of:

indicating a part selected for packing;

confirming selection of the part;

indicating a location in a shipping tote for placement of the part; and, sensing placement of the selected part in the location of the shipping tote.

32. The method of claim 31 further comprising the step of:

confirming placement of the selected part into the indicated location in the shipping tote.

33. The method of claim 32 further comprising the step of:

monitoring the part placed in the location in the shipping tote.

34. The method of claim 33 further comprising the step of:

generating an alarm, the alarm being responsive to a failure of the monitoring of the part placed in the location of the shipping tote wherein removal of the placed part from the location in the shipping tote generates the failure.

35. The method of claim 31 further comprising the step of:

generating an alarm, the alarm being responsive to a failure of the confirming selection of the part wherein selection of a wrong part generates the failure.

36. The method of claim 31 further comprising the step of:

generating an alarm, the alarm being responsive to a failure of the sensing placement of the selected part in the location of the shipping tote wherein misplacement of the selected part generates the failure.

37. The method of claim 31 further comprising the steps of:

sensing completion of the packing of the parts; and, printing a shipping label in response to the sensed completion of the packing of the parts.

38. A method of packing a shipment of parts, the method comprising the steps of:

placing a shipping tote for operable cooperation with a pack station, the pack station comprising an array of indicators, the array of indicators being operably connected to a programmable device, the array of indicators further being adaptable with the shipping tote;

identifying a part indicated for packing in the shipment;

selecting the part for placing into the shipping tote;

verifying the selection of the indicated part;

identifying a location indicated in the shipping tote for placement of the selected part; and, placing the selected part in the indicated location in the shipping tote, wherein the array of indicators cooperates with the programmable device to ensure proper placement of the part in the shipping tote.

39. The method of claim 38 wherein the pack station further comprises:

an array of sensors, the array of sensors being operably connected to a programmable device, the array of sensors further being adaptable with the shipping tote wherein the array of sensors cooperates with the programmable device to ensure proper placement of the parts in the shipping tote.

40. A method of packing a shipment of parts, the method comprising the steps of:

indicating a part selected for placing in a shipping tote;

identifying the part indicated for placing in the shipping tote;

selecting the part for placing in the shipping tote;

confirming selection of the selected part;

generating a first alarm, the first alarm being responsive to a selection failure of the confirming selection of the part wherein selection of a wrong part generates the selection failure;

verifying the selection of the indicated part;

indicating a location in the shipping tote for placement of the selected part;

identifying the location in the shipping tote for placement of the selected part;

placing the selected part in the indicated location in the shipping tote;

sensing placement of the selected part in the indicated location in the shipping tote; and, confirming placement of the selected part in the indicated location in the shipping tote.

41. The method of claim 40 further comprising the step of:

generating a second alarm, the second alarm being responsive to a placement failure of the sensing placement of the selected part in the location of the shipping tote wherein misplacement of the selected part generates the placement failure.

42. The method of claim 40 further comprising the steps of:

monitoring the part placed in the location of the shipping tote, generating a third alarm, the third alarm being responsive to a monitor failure of the monitoring of the part placed in the shipping tote wherein removal of the placed part from the location of the shipping tote generates the monitor failure.

43. The method of claim 40 further comprising the steps of:

sensing completion of the shipment of parts; and, printing a shipping label in response to the sensed completion of the shipment of parts.

* * * * *